US006402858B1

(12) United States Patent
Ishizaka

(10) Patent No.: US 6,402,858 B1
(45) Date of Patent: Jun. 11, 2002

(54) SUPER-CLEAN STEEL

(75) Inventor: Yukio Ishizaka, Miyako-gun (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/527,571

(22) Filed: Mar. 16, 2000

Related U.S. Application Data

(63) Continuation of application No. PCT/JP98/03242, filed on Jul. 17, 1998.

(51) Int. Cl.[7] ..... C22C 38/18; C22C 38/32; C22C 38/40

(52) U.S. Cl. ..... 148/333; 148/330; 148/334; 148/335

(58) Field of Search ..... 148/512, 508, 148/565, 330, 333, 334, 335; 420/104

(56) References Cited

U.S. PATENT DOCUMENTS 4,702,767 A * 10/1987 Takata et al. ..... 75/10.16

FOREIGN PATENT DOCUMENTS

| | | |
|---|---|---|
| JP | 05-040082 A | 2/1993 |
| JP | 07-151749 A | 6/1995 |
| JP | 07-286973 A | 10/1995 |
| JP | 09-209075 A | 8/1997 |

OTHER PUBLICATIONS

Yoshio Nuri and Kazusige Umezawa, "Development of Separation and Evaluation Technique of Non–metallic Inclusions in steel by Electron Beam Melting", Tetsu–to–Hagane, vol. 75 No. 10, 1989, pp. 1897 to 1904.

* cited by examiner

*Primary Examiner*—Deborah Yee
(74) *Attorney, Agent, or Firm*—Burns, Doane, Swecker & Mathis, LLP

(57) ABSTRACT

The steel of the present invention satisfies the following requirement for non-metallic inclusion area: when the steel is melted by an electron beam under the conditions of an irradiation rate of 200 to 600 J/sec., an irradeation time of 10 to 25 seconds, and an irradeation energy of 5000 J or more, the area of non-metallic inclusions existing in the surface of the sample after solidification falls within 15,000 $\mu m^2$ or less. The steel exhibits excellent cold workability and fatigue properties.

11 Claims, 4 Drawing Sheets

SUPER-CLEAN STEEL

This application is a continuation of international application PCT/JP98/03242 filed on Jul. 17, 1998.

FIELD OF THE INVENTION

The present invention relates to super-clean steel; i.e., steel having enhanced cleanliness. More particularly, the present invention relates to super-clean steel including steel for producing bridge cable, hose wire, bead wire, steel cord used as a reinforcing member in a radial tire of an automobile, or a valve spring used in a valve of an engine. Such super-clean steel exhibits excellent cold workability, as well as excellent fatigue properties required of products such as bridge cable, hose wire, bead wire, steel cord, and a valve spring.

BACKGROUND OF THE INVENTION

Some non-metallic inclusions (hereinafter may be referred to simply as "inclusions") in steel products exhibit useful effects; for example, MnS in free-cutting steel enhances machinability. However, the majority of inclusions are detrimental; i.e., they may reduce fatigue life, inhibit workability, or serve as starting points of destruction. Examples of such inclusions include inclusions in super-clean steel such as steel used for producing steel cord which is used as a reinforcing member in a radial tire of an automobile, or for producing a valve spring used in a valve of an engine. Particularly, high-melting-point inclusions such as alumina, spinel, and complexes thereof may considerably lower fatigue properties and cold workability, including drawability, workability in stranding, and forgeability. Therefore, steel products have been produced by means of a process in which inclusions are reduced considerably.

Known methods for evaluating cleanliness of steel products; i.e., for evaluating (examining) inclusions in steel products, include the JIS method, the ASTM method, and the MICHELIN method developed by COMPAGNIE GENERALE DES ETABLISSEMENTS MICHELIN. However, evaluation by way of these conventional methods is time consuming, since the methods are carried out by visual examination through an optical microscope. In addition, these methods involve problems in terms of accuracy and error in measurement.

Recently, techniques for producing super-clean steel have been developed, and thus the number of inclusions in super-clean steel has been reduced drastically. Therefore, in the case of the above-described typical evaluation methods making use of an optical microscope, steel products generally do not differ in cleanliness evaluation index, since inclusions rarely appear in a test surface; however, steel products differ considerably in terms of properties, such as cold workability, including drawability and fatigue properties. Thus, correlation between cleanliness evaluation index obtained by use of an optical microscope and properties of a product tends to be lost. When the area of a test surface is increased, correlation between cleanliness evaluation index obtained by use of an optical microscope and properties of a product can be confirmed. However, in this case, a very large test surface area is required, thus making the evaluation time-consuming and expensive.

Incidentally, "TETSU-TO-HAGANE" 75th year (1989) Vol. 10, p 1897–1904, describes that a cleanliness evaluation method utilizing an electron-beam melting can provide the information equivalent to that obtained from more than $10^5$ visual fields of measurement under the above-described method using an optical microscope. (Hereinafter, an electron beam may be referred to as an "EB," and a cleanliness evaluation method utilizing the electron-beam melting may be referred to as the "EB method.") The EB method is a method wherein an EB is radiated onto a sample (approximately 1–3 g) for melting the sample within a short period of time to thereby cause inclusions to rise to the surface of the sample, and after solidification of the sample, the inclusions in the surface are measured for evaluation (examination) of cleanliness. According to an exemplary embodiment of the method, a sample is placed on a Cu hearth cooled with water and then melted by irradiation with an EB under vacuum atmosphere.

The EB method does not require a very large area of test surface. Thus, the EB method can provide a more accurate evaluation of properties of a sample than the above-described test method using an optical microscope. In addition, the examination can be performed within a short period of time.

With regard to a method for evaluating cleanliness by means of the EB method, Japanese Patent Application Laid-Open (kokai) No. 40082/1993 among others discloses "a method for melting a sample for inclusion analysis" wherein inclusions in a sample can be effectively induced to rise to the surface of the sample. In addition, Japanese Patent Application Laid-Open (kokai) No. 151749/1995 discloses "a method for evaluating inclusions in a wire rod" wherein a steel product having a particular carbon concentration is subjected to EB melting.

BRIEF SUMMARY OF THE INVENTION

Among methods for evaluating cleanliness by the EB method, the technique disclosed in Japanese Patent Application Laid-Open (kokai) No. 40082/1993 determines only an energy irradiation rate during EB melting. Therefore, when a sample prepared by a melting method disclosed in the above publication is used, the obtained evaluation may reflect not only the effect of high-melting-point inclusions such as alumina, spinel, and complexes thereof, which adversely affect properties of steel products, but also the effect of low-melting-point inclusions such as MnS and $SiO_2$, which rarely affect properties of steel products. Accordingly, this technique cannot be used to evaluate only the effect of high-melting-point inclusions such as alumina, spinel, and complexes thereof, and thus cold workability and fatigue properties are not necessarily evaluated correctly and accurately.

Meanwhile, the technique disclosed in Japanese Patent Application Laid-Open (kokai) No. 151749/1995 pays no attention to conditions for energy irradiation during EB melting. Therefore, the method for evaluating cleanliness disclosed in the publication involves the same problem as in the above-described technique disclosed in Japanese Patent Application Laid-Open (kokai) No. 40082/1993. That is, the obtained evaluation may reflect not only the effect of high-melting-point inclusions, such as alumina, spinel, and complexes thereof, but also the effect of low-melting-point inclusions such as MnS and $SiO_2$, and thus cold workability and fatigue properties is not necessarily evaluated correctly and accurately.

In view of the foregoing, an object of the present invention is to provide super-clean steel exhibiting excellent cold workability and fatigue properties, by quantitatively confirming the effect of high-melting-point inclusions such as alumina, spinel, and complexes thereof, which are considerably detrimental to cold workability and fatigue properties.

The gist of the present invention resides in the following:

super-clean steel in which the area of non-metallic inclusions existing in the surface of a sample of the steel is not more than 15,000 $\mu m^2$ per gram, when the sample is melted by an electron-beam under the following conditions (per gram): an energy irradiation rate of 200–600 J/second, an irradiation time of 10–25 seconds, and an irradiation energy of 5,000 J or more, and then solidified.

The area of non-metallic inclusions present in the surface of the sample after solidification can be measured, for example, by observing the back-scattered electron image of the inclusions with a scanning electron microscope, and analyzing the electron image transmitted into an image processing apparatus.

Electron-beam melting (EB melting) is performed by irradiating a sample with an EB under vacuum atmosphere.

DETAILED DESCRIPTION

In order to evaluate high-melting-point inclusions which cause considerable deterioration of fatigue properties and cold workability, including drawability and forgeability, at different energy irradiation rates and irradiation times during EB melting, the present inventors studied the area of inclusions; the phenomenon of inclusions rising to the surface of a sample; i.e., the conditions of inclusions in the surface of the sample after solidification; and the phenomenon of decomposition of low-melting-point inclusions. One example of the results is shown in FIGS. 1 and 2.

Figure 1:
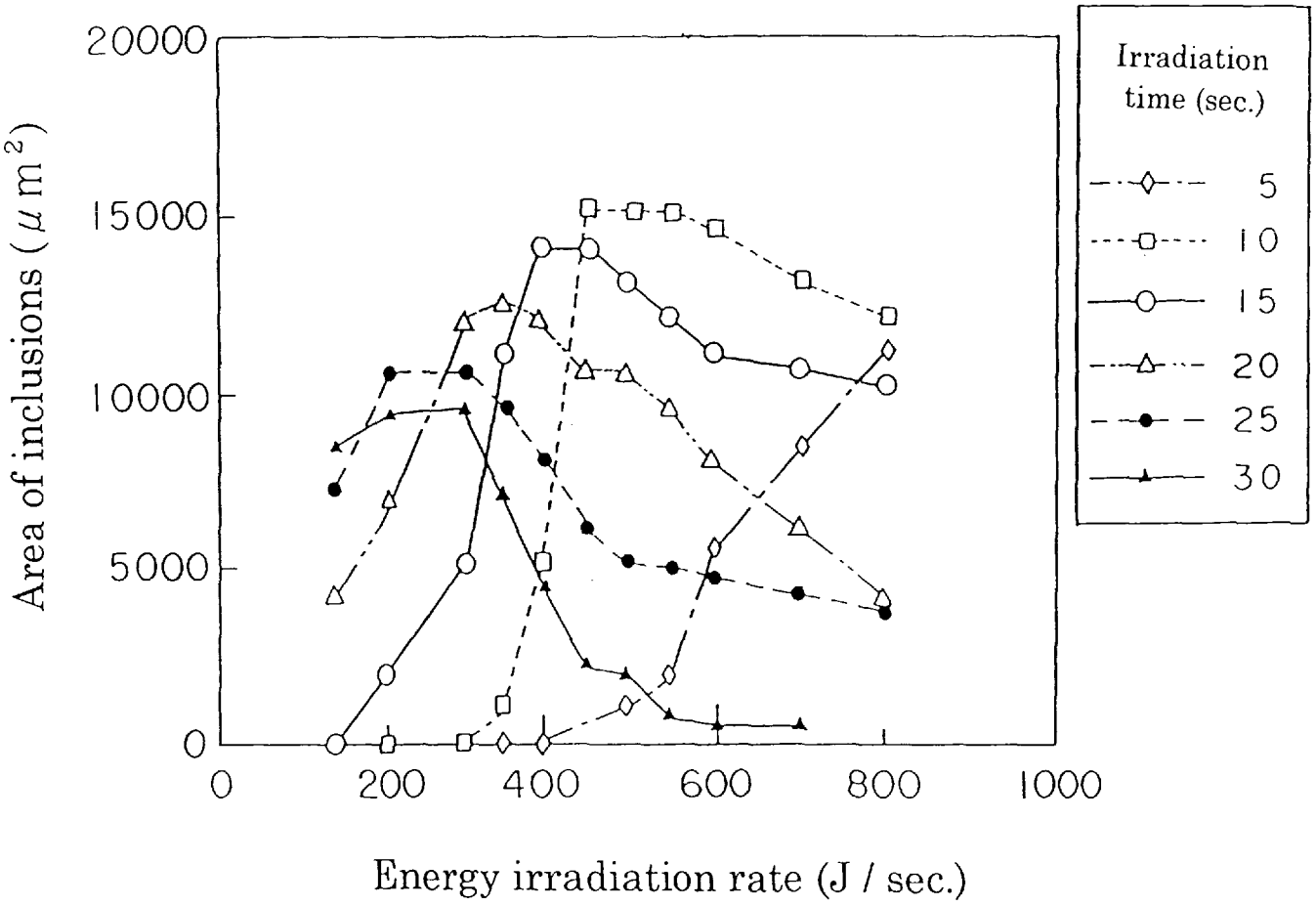
FIG. 1 is a graph showing the influence of energy irradiation rate and irradiation time during EB melting on the area of inclusions in the surface of a sample after solidification.
Figure 2:
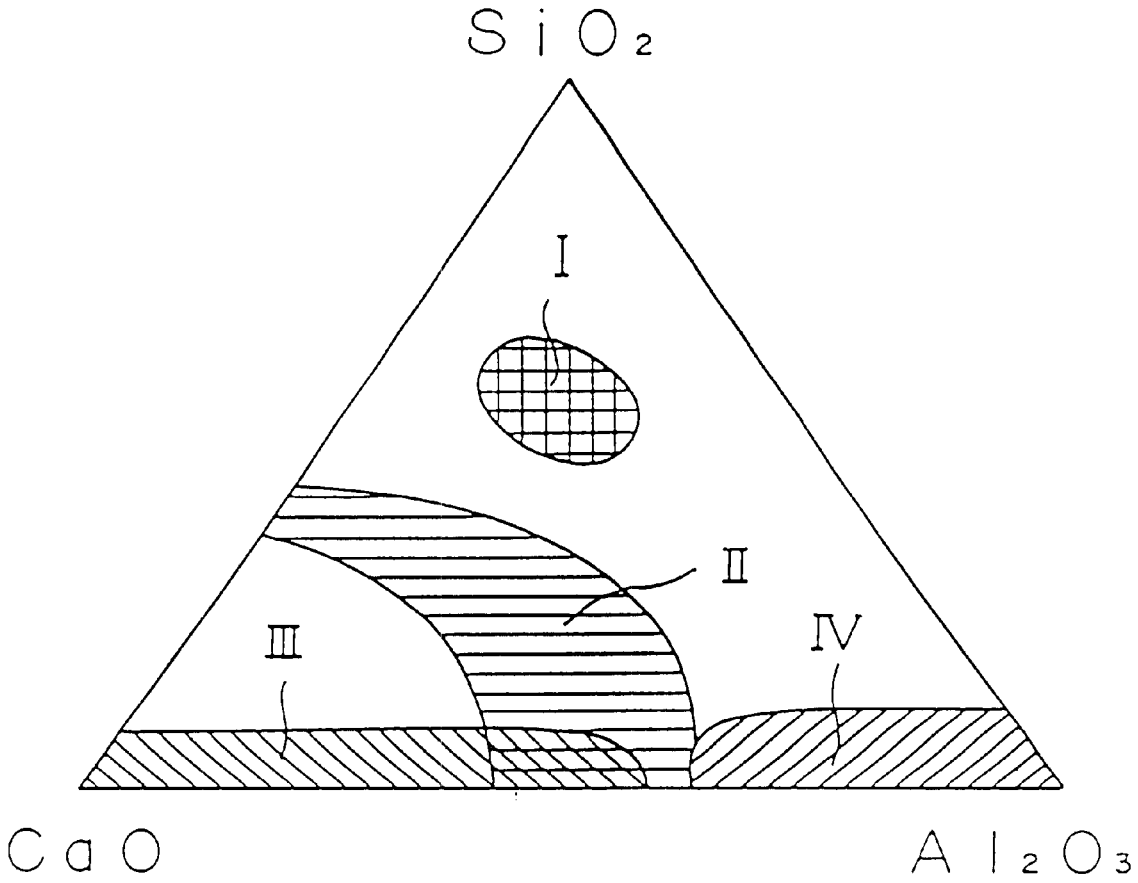
FIG. 2 shows the relation between EB melting conditions and change in composition of risen inclusions.

FIG. 1 shows the results of measurement of the areas of inclusions which appear in the surface of a sample; i.e., the areas of inclusions in the surface of the sample after solidification, at different energy irradiation rates within a range of 150–800 J/second, and for different irradiation times within a range of 5–30 seconds per gram of sample during EB melting. The sample was prepared according to the following procedure. Blooms were formed from steel having the chemical composition shown in Table 1 (values obtained through ladle analysis), which steel was subjected to deoxidation treatment through a typical refining method. The blooms were subjected to bloom-rolling and hot-forging through typically-employed methods, to thereby form a steel product having a diameter of 30 mm. A sample having a diameter of 5.5 mm and a length of 5 mm was cut out of the R/2 portion (R represents the radius of the steel product) of the thus-formed steel product. EB melting was performed by radiating an EB on the sample, which was placed on a Cu hearth cooled with water, under a vacuum atmosphere of $1\times10^{-5}$ to $1\times10^{-6}$ torr.

TABLE 1

| Chemical composition (wt. %) Balance: Fe and impurities | | | | | | | | | | | | |
|---|---|---|---|---|---|---|---|---|---|---|---|---|
| C | Si | Mn | P | S | Cu | Ni | Cr | Mo | Co | V | B | Al |
| 0.74 | 0.19 | 0.51 | 0.007 | 0.005 | 0.03 | 0.02 | 0.03 | 0.01 | — | 0.002 | — | 0.001 |

FIG. 2 shows the relation between the composition of inclusions and energy irradiation rate per gram of sample during EB melting when the irradiation time was 15 seconds in the above-described measurement. In the same manner, EB melting was performed by radiating an EB on a sample placed on a Cu hearth cooled with water under a vacuum atmosphere of $1\times10^{-5}$ to $1\times10^{-6}$ torr.

Ca—Al—Si oxides are shown in FIG. 2. Of these, Ca and Al are derived from flux and refractory, which are added during refining, and Si represents residue of Si which is added as a deoxidizer. In FIG. 2, region I refers to the composition of inclusions in the case where a sample is cut out of a product and polished and the polished sample is subjected to measurement by use of an electron probe microanalyzer (EPMA). When a sample whose composition of inclusions is in region I is subjected to EB melting, the compositions of inclusions present in the surface of the sample are in region II, region III, or region IV, depending on energy irradiation rate per gram of sample during EB melting. Region II, region III, and region IV represent the compositions of inclusions when 1 g of the sample is subjected to EB melting at energy irradiation rates of 150–400 J/second, 400–500 J/second, and 500–800 J/second, respectively. In FIG. 2, the melting points of inclusions; i.e., CaO, $Al_2O_3$, and $SiO_2$, are 2,572° C., 2,050° C., and 1,702° C., respectively.

The following are apparent from FIGS. 1 and 2.

(i) In the case where the energy irradiation rate during EB melting is less than 200 J/second per gram of sample, even when EB irradiation time is long, energy is insufficient, and thus a sample melts incompletely and only a fraction of inclusions rise to the surface of the sample. Namely, when the energy irradiation rate is less than 200 J/second per gram of sample during EB melting, not all inclusions in a sample rise to the surface of the sample.

(ii) For all irradiation times, the area of risen inclusions gradually decreases after attaining a peak value; i.e., a certain energy irradiation rate. The peak value corresponds to an EB irradiation condition wherein the irradiation energy per gram of sample is approximately 5,000 J.

(iii) When the energy irradiation rate per gram of sample during EB melting increases; i.e., when the irradiation energy increases, the composition of inclusions in the surface of the sample shifts to a high-melting-point side, for the reasons described below. After all inclusions in a sample rise to the surface of the sample (a peak position), irradiation with an electron beam promotes reduction by carbon contained in steel, and oxide inclusions of low melting point are successively reduced and decomposed.

(iv) As is apparent from the above-described (i) through (iii), within a range of an energy irradiation rate wherein a sample melts completely; i.e., within a range of energy irradiation rate of not less than 200 J/second per gram of sample during EB melting, energy irradiation rate varies with irradiation time, but the area of inclusions in the surface of the sample after solidification reaches a maximum when the irradiation energy is approximately 5,000 J per gram of sample. (Hereinafter the position where the area of inclusions in the surface of a sample after solidification reaches a maximum will be referred to as the "peak position.") In addition, on the basis of the peak position, state of inclusions that float up to the surface are classified into the following (a) through (c).

Namely, (a) represents the state in which not all inclusions have risen to the surface; (b) represents the state in which all inclusions in a sample have risen to the surface; and (c) represents the state in which risen oxide inclusions of low melting point are successively reduced and decomposed, and high-melting-point inclusions remain above the peak position.

The present inventors conducted further studies, and found it necessary to provide an upper limit of energy irradiation rate per gram of sample during EB melting. This is because when energy irradiation rate becomes very high, splashing may occur in a part of a sample which starts to melt at an initial stage of sample melting. When splashing occurs during sample melting, the following problems arise:

(v) inclusions in a sample also splash; and (vi) flow of a melted portion becomes strong and inclusions risen to the surface of a sample become engulfed inside the sample due to strong flow. As a result, appropriate information cannot be obtained. Thus, the above-described splashing must be suppressed.

Table 2 shows the relation between energy irradiation rate (Ev) and splash ratio (the number of samples wherein splashing occurs/the total number of melted samples) when the irradiation time (t) during EB melting is 5–25 seconds per gram of sample. In this case, EB melting is performed by radiating an EB on a sample placed on a Cu hearth cooled with water, under a vacuum atmosphere of $1\times10^{-5}$ to $1\times10^{-6}$ torr.

TABLE 2

| Ev (J/second) | 290 | 300 | 400 | 500 | 600 | 700 | 800 | t (second) |
|---|---|---|---|---|---|---|---|---|
| Splash ratio (%) | 0 | 0 | 0 | 0 | 0 | 0 | 0 | 5 |
| Splash ratio (%) | 0 | 0 | 0 | 10 | 30 | 80 | 85 | 10 |
| Splash ratio (%) | 0 | 0 | 10 | 15 | 30 | 80 | 90 | 15 |
| Splash ratio (%) | 0 | 0 | 30 | 40 | 45 | 90 | 96 | 20 |
| Splash ratio (%) | 0 | 0 | 30 | 45 | 50 | 98 | 98 | 25 |

Ev represents energy irradiation rate, and t represents irradiation time.

As is apparent from Table 2, when the energy irradiation rate is in excess of 600 J/second, significant splashing occurs and the splash ratio may exceed 50%.

In view of the above, in the present invention, wherein an object is to quantitatively confirm the effect of high-melting-point inclusions which adversely affect cold workability and fatigue properties, the energy irradiation rate during EB melting is 200–600 J/second per gram of sample.

In order to efficiently and accurately evaluate high-melting-point inclusions which adversely affect the properties of steel products, energy must be provided in at least an amount corresponding to the peak value of the area of risen inclusions as described above. Therefore, in the present invention, the irradiation energy is 5,000 J or more per gram of sample. No particular limitation is imposed on the upper limit of irradiation energy, and for example, the irradiation energy may be 15,000 J, as in the case where the energy irradiation rate is 600 J/second and the irradiation time is 25 seconds.

When the EB irradiation time is less than 10 seconds per gram of sample, applying a desired irradiation energy of 5,000 J to a sample requires a high energy irradiation rate. As a result, splashing may occur in a portion of the sample which starts to melt at an initial stage of sample melting. In contrast, when the EB irradiation time exceeds 25 seconds per gram of sample, irradiation energy becomes very high and high-melting-point inclusions may be reduced and decomposed, and thus appropriate information cannot be obtained. Therefore, in the present invention, the EB irradiation time is 10–25 seconds per gram of sample.

As described above, in the present invention, EB melting is performed by radiating EB on a sample under vacuum atmosphere. For example, EB melting may be performed by radiating EB on a sample placed on a Cu hearth cooled with water, under vacuum atmosphere (e.g., under a vacuum atmosphere of $1\times10^{-5}$ to $1\times10^{-6}$ torr).

Subsequently, the present inventors studied the relation between the area of non-metallic inclusions in the surface of a sample, and cold-workability and fatigue properties, which sample was obtained by subjecting steel products of different chemical compositions to EB melting under the above-described condition of the present invention under a vacuum atmosphere of $1\times10^{-5}$ to $1\times10^{-6}$ torr, and by solidifying the products. As a result, they found that when the area of non-metallic inclusions is 15,000 $\mu m^2$ or less per gram of sample, as shown in one example described below, steel consistently exhibits excellent cold workability and fatigue properties. Therefore, in the present invention, the area of non-metallic inclusions is determined to be 15,000 $\mu m$ or less per gram of sample, which inclusions exist in the surface of a sample after the sample is melted by an electron-beam under the conditions of the present invention and is solidified.

In order to maintain the area of high-melting point inclusions such as alumina, spinel, and complexes thereof at 15,000 $\mu m^2$ or less per gram of sample, which inclusions exist in the surface of a sample after the sample is melted by an electron-beam under the conditions of the present invention and is solidified, for example, in addition to Si typically added for deoxidation, a ferroalloy containing a trace amount of Al may be used in order to prevent generation of high-melting-point inclusions, and the composition of low-melting-point inclusions may be regulated by use of flux, to thereby produce steel.

In the super-clean steel of the present invention, properties of inclusions are controlled, and thus the chemical composition of steel is not particularly limited. However, cold workability and fatigue properties vary greatly not only with inclusions but also with the chemical composition of steel product. Therefore, in super-clean steel of the present invention, the chemical composition of steel may be defined as described below.

Hereinafter, the symbol "%," which indicates the amount of each chemical component, represents percent by weight.

C:

C is an effective element for enhancing the strength of steel. However, when the C content is excessive, steel products are hardened, resulting in deterioration of cold workability. Particularly, when the C content is in excess of 1.1%, preciptation of cementite into a prior-austenite grain boundary increases and steel products are hardened, with the result that cold workability and fatigue properties are deteriorated significantly. Therefore, the C content is preferably 1.1% or less. The lower limit of the C content is determined in view of the required strength.

Si:

Si is an effective element for reinforcing a matrix, as well as for exerting a deoxidation effect. However, when the Si content is less than 0.1%, the addition of Si induces a poor effect; and in contrast, when the Si content is in excess of 1.5%, a decarburized layer is partially formed, resulting in deterioration of fatigue properties. Therefore, the Si content is preferably 0.1–1.5%.

Mn:

Mn fixes S solid-soluted in steel in the form of MnS, and exerts a deoxidation effect, thus restraining deterioration of toughness. However, when the Mn content is less than 0.2%, the above-described effect is difficult to obtain, and in contrast, when the Mn content is in excess of 1.0%, martensite or bainite is formed, resulting in deterioration of cold workability. Therefore, the Mn content is preferably 0.2–1.0%.

Cr:

Cr reduces the lamellar spacing of pearlite and improves the strength of steel. Also, because Cr improves the work hardening ratio during cold working, such as drawing, the addition of Cr can provide high strength to the steel even at a comparatively low working ratio. However, when the Cr content is less than 0.01%, the addition induces a poor effect. In contrast, when Cr is added in excess, hardenability becomes high and martensite or bainite is formed, resulting in deterioration of cold workability. Particularly, when the Cr content is in excess of 2.0%, a great deal of martensite or bainite is formed, resulting in significant deterioration of cold workability. Furthermore, not only does patenting treatment for steel wire become difficult but also secondary scale becomes excessively tight, thus deteriorating the effectiveness of descaling performed by a mechanical treatment or a pickling treatment. Therefore, the Cr content is preferably 0.01–2.0%.

Cu:

Addition of Cu is not necessary. If Cu is added, Cu improves the strength of steel by precipitation hardening and improves corrosion resistance. In order to ensure attainment of these effects, the Cu content is preferably 0.05% or more. However, when the Cu content is in excess of 1.0%, ductility is lost. Therefore, the Cu content is preferably 1.0% or less.

Ni:

Addition of Ni is not necessary. If Ni is added, age hardening by C or N is delayed, deterioration of toughness and ductility is prevented, and a reduction of area is enhanced. In order to ensure attainment of these effects, the Ni content is preferably 0.05% or more. However, when the Ni content is in excess of 1.0%, martensite or bainite is likely to be formed, resulting in deterioration of cold workability. Therefore, the Ni content is preferably 1.0% or less.

Mo:

Addition of Mo is not necessary. If Mo is added, the strength of steel is improved. In order to ensure attainment of this effect, the Mo content is preferably 0.03% or more. However, when the Mo content is in excess of 1.0%, martensite or bainite is likely to be formed, resulting in deterioration of cold workability. Therefore, the Mo content is preferably 1.0% or less.

W:

Addition of W is not necessary. If W is added, as in the same case of Cr, work hardening ratio during cold working is improved significantly. In order to ensure attainment of this effect, the W content is preferably 0.1% or more. However, when the W content is in excess of 0.5%, hardenability of steel becomes excessively high, resulting in difficulty in carrying out patenting treatment. Therefore, W content is preferably 0.5% or less.

Co:

Addition of Co is not necessary. If Co is added, Co prevents the deposition of pro-eutectoid cementite and also refines pearlite, resulting in enhancement of strength. In order to ensure attainment of these effects, the Co content is preferably 0.05% or more. However, when the Co content is in excess of 1.0%, the above-described effect cannot be obtained in a commensurable manner, and further addition only increases cost. Therefore, Co content is preferably 1.0% or less.

V:

Addition of V is not necessary. If V is added, V improves the strength of steel. In order to ensure attainment of this effect, the V content is preferably 0.05% or more. However, when the V content is in excess of 1.0%, martensite or bainite is likely to be formed, resulting in deterioration of cold workability. Therefore, the V content is preferably 1.0% or less.

Nb:

Addition of Nb is not necessary. If Nb is added, Nb refines austenite grains, resulting in the improvement of ductility and toughness. In order to ensure attainment of these effects, the Nb content is preferably 0.01% or more. However, when the Nb content is in excess of 0.1%, the above-described effect cannot be increased in a commensurable manner, and further addition of Nb only increases cost. Therefore, Nb content is preferably 0.1% or less.

B:

Addition of B is not necessary. If B is added, Baccelerates the growth of cementite in pearlite, improving cold workability and fatigue properties. In order to ensure attainment of these effects, the B content is preferably 0.0005% or more. However, when the B content is in excess of 0.01%, B segregates in grain boundaries, resulting in deterioration of toughness and ductility. Therefore, B content is preferably 0.01% or less.

The amounts of impurities; i.e., P, S, and Al are preferably limited to the following levels.

P

P is an element which is likely to segregate, and deteriorates the toughness and ductility of steel. Particularly, when the P content is in excess of 0.025%, toughness and ductility are deteriorated significantly. Therefore, the P content is preferably 0.025% or less.

S:

S is an element which is likely to segregate, and deteriorates the toughness and ductility of steel. Particularly, when the S content is in excess of 0.025%, toughness and ductility are deteriorated significantly. Therefore, the S content is preferably 0.025% or less.

Al:

If Al is contained in excess, a great amount of non-metallic high-melting-point inclusions, such as $Al_2O_3$ or $MgO—Al_2O_3$, are formed and cause breakage in the process of cold working such as wet drawing and stranding. Particularly, when the Al content is in excess of 0.003%, breakage may frequently occur in the process of above-described cold working. Therefore, the Al content is preferably 0.003% or less.

For bead wire or a steel cord used as a reinforcing member for a radial tire of an automobile, steel having the following chemical composition is preferably used; C: 0.69–1.1%, Si: 0.1–1.0%, Mn: 0.2–1.0%, Cr: 0.01–1.0%, Cu: up to 0.5%, Ni: up to 0.5%, Mo: up to 0.5%, W: up to 0.5%, Co: up to 0.5%, V: up to 0.1%, Nb: up to 0.1%, B: up to 0.005%, and balance: Fe, and inevitable impurities, including P: up to 0.025%, S: up to 0.025%, and Al: up to 0.003% (% represents weight %).

For a valve spring used in a valve of an engine, steel having the following chemical composition is preferably used; C: 0.5–0.7%, Si: 0.1–1.5%, Mn: 0.2–1.0%, Cr: 0.01–1.5%, Cu: up to 0.5%, Ni: up to 1.0%, Mo: up to 0.5%, W: up to 0.5%, Co: up to 1.0%, V: up to 0.5%, Nb: up to 0.1%, B: up to 0.005%, and balance: Fe, and inevitable impurities, including P: up to 0.025%, S: up to 0.025%, and Al: up to 0.003% (% represents weight %)

EXAMPLES

The present invention will next be described in detail by way of examples, which should not be construed as limiting the invention thereto.

Example 1

A variety of steels having chemical compositions shown in Table 3 were subjected to a deoxidation treatment under various conditions, and the treated steels in an amount of 3 tons were melted in a test furnace and made into steel ingots. The steel ingots were subjected to bloom rolling and wire rolling according to a conventional method, to thereby obtain wire rods having a diameter of 5.5 mm.

TABLE 3

| Chemical composition (wt. %) Balance: Fe and impurities | | | | | | | | | | | | |
|---|---|---|---|---|---|---|---|---|---|---|---|---|
| C | Si | Mn | P | S | Cu | Ni | Cr | Mo | Co | V | B | Al |
| 0.69 | 0.16 | 0.25 | 0.005 | 0.003 | 0.01 | 0.01 | 0.02 | 0.01 | — | 0.001 | — | — |
| — | — | — | — | — | — | — | — | — | — | — | — | — |
| 1.10 | 0.25 | 0.55 | 0.012 | 0.010 | 0.04 | 0.04 | 0.50 | 0.02 | 0.04 | 0.004 | 0.0010 | 0.001 |

The thus-obtained wire rods were cut into pieces of about 1 g weight, to thereby obtain EB-melting samples, and subjected to pickling according to a conventional method so as to remove mill scale adhering on the surface. Next, the wire rod samples were subjected to ultrasonic cleaning in alcohol, and after drying, were mounted to an EB instrument (product of NIHON-DENSHI [JEOL Ltd.]: JEBM-3IAI). After a vacuum of $1\times10^{-5}$to $10^{-6}$ torr was attained in the interior of the EB instrument, the samples were placed on a water-cooled Cu hearth and melted under the EB-melting conditions specified by the present invention such that the irradiation rate of energy was 420 J/sec. and irradiation time was 15 seconds. After solidification of the samples, inclusions existing in the surface of the samples were observed through a scanning electron microscope, and the areas occupied by the obtained inclusion images were measured by use of a multipurpose image processing instrument. As Comparative Examples, the samples were EB-melted under the conditions of an irradiation rate of energy of 450 J/sec. and an irradiation time of 10 seconds. After solidification of the samples, the areas of inclusions existing in the surface of the samples (hereinafter, referred to as "the areas of non-metallic inclusions" or "the area of inclusions") was measured in the same manner as the above-described Examples wherein the samples were EB-melted under the conditions specified by the present invention.

Meanwhile, each of the thus-obtained wire rods having a diameter of 5.5 mm was subjected to cold drawing according to a conventional method so as to reduce the diameter to 0.2 mm.

Figure 3:
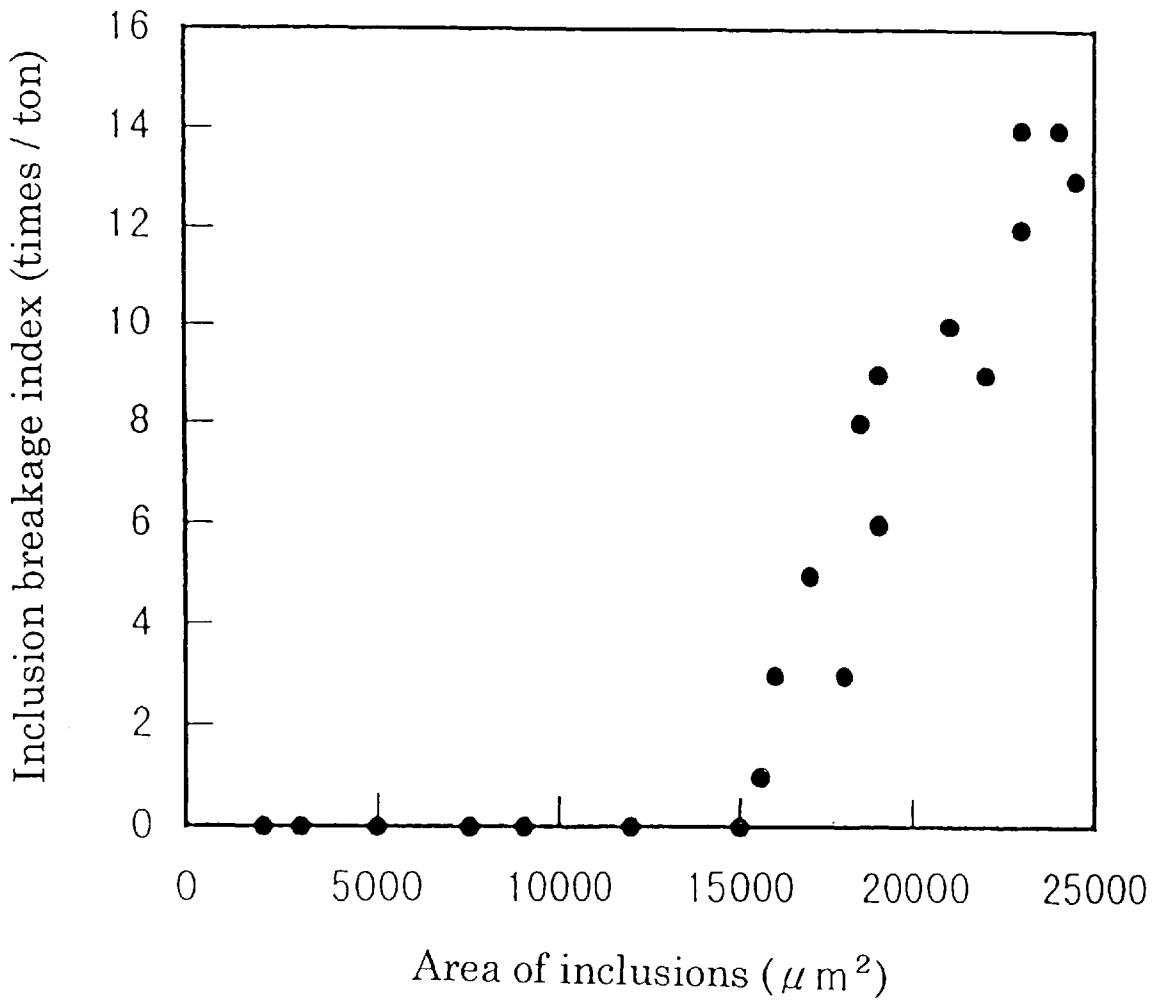
FIG. 3 is a graph showing the relation between inclusion breakage index and the area of inclusions in the surface of a sample after solidification in the case where EB melting is performed under the conditions employed in Example 1 in the present invention.
Figure 4:
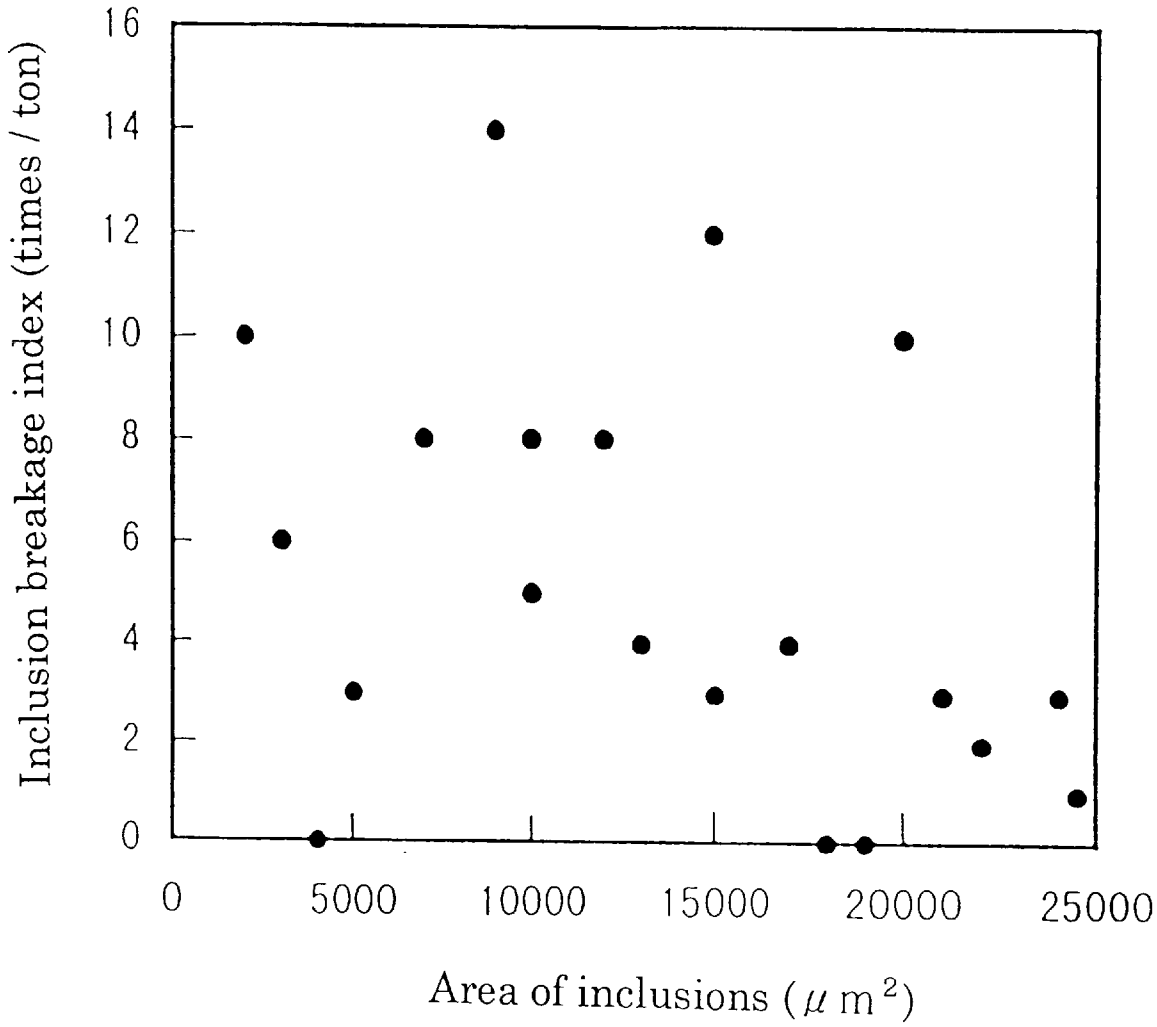
FIG. 4 is a graph showing the relation between inclusion breakage index and the area of inclusions in the surface of a sample after solidification in the case where EB melting is performed under the conditions employed in Comparative Example 1, which fall outside the scope of the present invention.

FIGS. 3 and 4 show the relation between the measured area of non-metallic inclusions (reduced to values per 1 g of a sample) and breakage index (times/ton) of wire rods per 1 ton in the process of cold drawing to reduce diameter from 5.5 mm to 0.2 mm, attributed to non-metallic inclusions (hereinafter referred to as "inclusion breakage index"). FIG. 3 shows the relation between the area of inclusions and inclusion breakage index in Examples wherein the sample was EB-melted under the conditions specified by the present invention. FIG. 4 shows the relation between the area of inclusions and inclusion breakage index in the Comparative Examples wherein the samples were EB-melted under conditions deviating from the conditions defined in the present invention.

In FIG. 4, wherein the samples were EB-melted under the conditions of Comparative Examples which deviate from the conditions defined in the present invention, the areas of non-metallic inclusions are scattered, and no correlation with the breakage indexes of inclusions is found.

In contrast, in FIG. 3, wherein the samples were EB-melted under the conditions specified by the present invention, close correlation is found between the area of non-metallic inclusions and inclusion breakage index. This is because when the sample is EB-melted under the conditions specified by the present invention, high-melting-point inclusions in steel can be evaluated, and drawing workability attributed to high-melting-point inclusions can be evaluated. From FIG. 3, it is clear that when a sample is EB-melted under the conditions specified by the present invention, if the area of non-metallic inclusions is 15,000 $\mu m^2$ or less per 1 g of sample, inclusion breakage index is extremely low, resulting in stable and favorable cold workability.

Example 2

A variety of steels having chemical compositions shown in Table 4 were treated under conditions A to C, and the treated steels in an amount of 3 tons were melted in a test furnace and formed into steel ingots. The steel ingots were subjected to bloom rolling and wire rolling in accordance with conventional methods, to thereby obtain wire rods having a diameter of 9.5 mm.

TABLE 4

| Chemical composition (wt. %) Balance: Fe and impurities | | | | | | | | | | | | |
|---|---|---|---|---|---|---|---|---|---|---|---|---|
| C | Si | Mn | P | S | Cu | Ni | Cr | Mo | Co | V | B | Al |
| 0.63 | 0.16 | 0.62 | 0.007 | 0.005 | 0.01 | 0.01 | 0.43 | 0.01 | — | 0.155 | — | — |
| — | — | — | — | — | — | — | — | — | — | — | — | — |
| 0.65 | 0.21 | 0.67 | 0.013 | 0.008 | 0.04 | 0.04 | 0.46 | 0.02 | 0.04 | 0.171 | 0.0010 | 0.001 |

Condition A: In addition to Si for attaining conventional deoxidation, a ferroalloy containing an extremely small amount of Al was added in order to prevent the formation of high-melting-point inclusions, and the composition of low-melting-point inclusions was controlled by addition of flux, to thereby obtain an steel ingot.

Condition B: In addition to performance of conventional deoxidation with Si, composition of inclusions with low melting point was controlled by addition of flux, to thereby obtain an steel ingot.

Condition C: Conventional deoxidation with Si—Al was performed, to thereby obtain an steel ingot.

The thus-obtained wire rods were cold drawn to a diameter of 5.5 mm in accordance with a conventional method; cut into pieces of about 1 g weight, to thereby obtain EB-melting samples; and subjected to pickling in accordance with a conventional method so as to remove mill scale adhering on the surface. Next, the samples of wire rods were subjected to ultrasonic cleaning in alcohol, and after drying, were mounted to the EB instrument as described in Example 1.

After a vacuum of $1\times10^{-5}$ to $10^{-6}$ torr was attained in the interior of the EB instrument, the samples were placed on a water-cooled Cu hearth and melted under the EB-melting conditions specified by the present invention such that the irradiation rate of energy was 420 J/sec. and irradiation time was 15 seconds. After solidification of the samples, inclusions existing in the surface of the samples were observed through a scanning electron microscope, and the areas of the obtained inclusion images were measured by use of a multipurpose image processing instrument.

Meanwhile, each steel wire having a diameter of 5.5 mm obtained through cold drawing was subjected to oil quenching and tempering, followed by shot peening carried out in accordance with a conventional method. The quenching temperature was 900° C., and the tempering temperature was 430° C. After shot peening, the samples was heated at 215° C. for 30 minutes, followed by air-cooling.

The thus-obtained steel wire was cut into a piece 500 mm in length, and the piece was subjected to a Nakamura-type rotating bending fatigue test to thereby examine fatigue properties. Stress used in the test was 725 MPa.

Table 5 shows the results of the Nakamura-type rotating bending fatigue test. In the Table 5, groups A, B, and C correspond to steel produced under the respective conditions A, B, and C described above.

TABLE 5

| | Fatigue properties | |
|---|---|---|
| Group | Number of repetitions until breakage | Starting point of breakage |
| A | $5\times10^5$–$1\times10^8$ | Surface |
| B | $2.8\times10^5$–$1\times10^8$ | Surface and inclusions |
| C | $1.2\times10^5$–$3.1\times10^7$ | Surface and inclusions |

When the steel was EB-melted under the above-described conditions, the areas of inclusions (reduced to values per 1 g of sample) were 1,000–15,000 $\mu m^2$ for group A, greater than 5,000 but not greater than 20,000 $\mu m^2$ for group B, and greater than 20,000 but not greater than 50,000 $\mu m^2$ for group C.

From FIG. 5, it is clear that when a sample is EB-melted under the conditions specified by the present invention, if the area of non-metallic inclusions is 15,000 $\mu m$ or less per 1 g of sample, breakage started from the inclusions does not occur, thus exhibiting stable and favorable fatigue properties.

Industrial Applicability

The super-clean steel of the present invention includes small amounts of high-melting-point non-metallic inclusions, which exerts bad influence on cold workability and fatigue properties, and therefore the super-clean steel is an effective material for applications such as bridge cable, hose wire, bead wire, steel cord, and valve springs.

What is claimed is:

1. A super-clean steel which has a chemical composition of, by weight, C: 1.1% or less, Si: 0.1–1.5%, Mn: 0.2–1.0%, Cr: 0.01–2.0%, Cu: up to 1.0%, Ni: up to 1.0%, Mo: up to 1.0%, W: up to 0.5%, Co: up to 1.0%, V: up to 1.0%, Nb: up to 0.1%, B: up to 0.01 %, and balance: Fe, and inevitable impurities, including P: up to 0.025%, S: up to 0.025%, and Al: up to 0.003%, and Ca—Al—Si oxide inclusions having a composition defined by region (I) in FIG. 2 of the present application, wherein the area of non-metallic inclusions existing in the surface of the steel is not more than 15,000 $\mu m^2$ per gram when the steel is melted by an electron-beam under the following conditions (per gram): an energy irradiation rate of 200 to 600 J/second, an irradiation time of 10 to 25 seconds, and an irradiation energy of 5,000 J or more, and solidified.

2. A super-clean steel according to claim 1, wherein Cu is contained in an amount of 0.05 % or more.

3. A super-clean steel according to claim 1, wherein Ni is contained in an amount of 0.05 % or more.

4. A super-clean steel according to claim 1, wherein Mo is contained in an amount of 0.03 % or more.

5. A super-clean steel according to claim 1, wherein W is contained in an amount of 0.1 % or more.

6. A super-clean steel according to claim 1, wherein Co is contained in an amount of 0.05 % or more.

7. A super-clean steel according to claim 1, wherein V is contained in an amount of 0.05 % or more.

8. A super-clean steel according to claim 1, wherein Nb is contained in an amount of 0.01% or more.

9. A super-clean steel according to claim 1, wherein B is contained in an amount of 0.0005 % or more.

10. A super-clean steel which has a chemical composition of, by weight, C: 0.69–1.1%, Si: 0.1–1.0%, Mn: 0.2–1.0%, Cr: 0.01–1.0%, Cu: up to 0.5%, Ni: up to 0.5%, Mo: up to 0.5%, W: up to 0.5%, Co: up to 0.5%, V: up to 0.1%, Nb: up to 0.1 %, B: up to 0.005 %, and balance: Fe, and inevitable impurities, including P: up to 0.025%, S: up to 0.025%, and Al: up to 0.003%, and Ca—Al—Si oxide inclusions wherein the area of non-metallic inclusions existing in the surface of the steel is not more than 15,000 $\mu m^2$ per gram when the steel is melted by an electron-beam under the following conditions (per gram): an energy irradiation rate of 200 to 600 J/second, an irradiation time of 10 to 25 seconds, and an irradiation energy of 5,000 J or more, and solidified, wherein the steel is a cord or bead wire as a reinforcing member of a radial tire of an automobile.

11. A super-clean steel which has a chemical composition of, by weight, C: 0.5–0.7%, Si: 0.1–1.5%, Mn: 0.2–1.0%, Cr: 0.01–1.5%, Cu: up to 0.5%, Ni: up to 1.0%, Mo: up to 0.5%, W: up to 0.5%, Co: up to 1.0%, V: up to 0.5%, Nb: up to 0.1 %, B: up to 0.005%, and balance: Fe, and inevitable impurities, including P: up to 0.025%, S: up to 0.025%, and Al: up to 0.003%, and Ca—Al—Si oxide inclusions wherein the area of non-metallic inclusions existing in the surface of the steel is not more than 15,000 $\mu m^2$ per gram when the steel is melted by an electron-beam under the following conditions (per gram): an energy irradiation rate of 200 to 600 J/second, an irradiation time of 10 to 25 seconds, and an irradiation energy of 5,000 J or more, and solidified, wherein the steel is a valve spring of an engine.

* * * * *